US006601246B2

(12) United States Patent
Leung et al.

(10) Patent No.: US 6,601,246 B2
(45) Date of Patent: Aug. 5, 2003

(54) BUBBLING BATH MAT

(75) Inventors: Anthony Kit Lun Leung, Hong Kong (HK); Chung Shun Tse, Hong Kong (HK); Kam Fai Fung, Hong Kong (HK)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 09/919,296

(22) Filed: Jul. 31, 2001

(65) Prior Publication Data

US 2003/0024042 A1 Feb. 6, 2003

(51) Int. Cl.[7] ..... A61H 33/02
(52) U.S. Cl. ..... 4/559; 4/541.5; 4/583
(58) Field of Search ..... 4/541.5, 559, 581, 4/583; 601/168

(56) References Cited

U.S. PATENT DOCUMENTS

| | | | | | |
|---|---|---|---|---|---|
| 1,019,212 | A | * | 3/1912 | Yates | 4/583 |
| 2,848,203 | A | * | 8/1958 | Misiura | 4/559 X |
| 3,240,208 | A | * | 3/1966 | Everston | 4/559 X |
| 3,299,885 | A | * | 1/1967 | Wessel | 4/583 X |
| 4,048,266 | A | | 9/1977 | Baumann | 4/541.5 X |
| 5,050,591 | A | | 9/1991 | Sandrin | 4/541.5 X |
| 5,054,473 | A | | 10/1991 | Sandrin | 4/541.5 X |
| 5,307,529 | A | | 5/1994 | Wang | 4/585 |

FOREIGN PATENT DOCUMENTS

| | | | | |
|---|---|---|---|---|
| DE | 2854503 | * | 6/1980 | 4/541.5 |

* cited by examiner

*Primary Examiner*—Robert M. Fetsuga
(74) *Attorney, Agent, or Firm*—Ohlandt, Greeley, Rugglero & Perle, LLP

(57) ABSTRACT

There is provided a soft bubbling bath mat having a mat body of molded flexible material that houses a soft flexible foam pad adapted to fit between an outer edge of the mat body an interior air passageway. The air passageway is adapted at one end to form an inlet port. The inlet port is adapted to receive air to be fed from a compressed air source to the passageway and forced through the passageway and out through a plurality of small apertures in a top surface of the passageway creating a therapeutic bubbling massage effect.

4 Claims, 2 Drawing Sheets

BUBBLING BATH MAT

BACKGROUND OF THE INVENTION

1. Field of the Invention

The present invention relates to a bubbling bath mat. More particularly, the present invention relates to a soft bubbling bath mat that provides a bubbling massage having a therapeutic aeration effect.

2. Description of the Prior Art

Soft bubbling bath mats are relatively well known. For example, U.S. Pat. No. 5,050,591 to Sandrin describes a soft bath mat capable of providing a bubbling massage. The mat is arranged in a two-channel configuration. A first channel inflates and supports a user and a second channel allows air received from a compressed air source to escape from a plurality of small apertures in its upper surface. The upper surface of the second channel sits vertically lower than the upper surface of the first channel. This arrangement enables a user to be supported by the first channel without blocking the air escaping from the second channel. The drawback of this type of bath mat is the time and effort required to use the device (i.e. inflate prior to use and deflate after use).

Efforts have been made to improve the efficiency in using a bath mat similar to that described above. For example, it is known to provide a soft bubbling bath mat that, rather than using the two-channel configuration described above, uses a plurality of flexible rectangular pads arranged so as to support a user and not inhibit the air escaping from the upper surface of the mat. The drawback of this arrangement is that the flexible pads can and do create localized pressure points that often result in an unpleasant effect on a user.

None of the above provide a soft bubbling bath mat that not only improves the therapeutic aeration effect, but also improves comfort without creating localized pressure point. In addition, the present invention provides for a compact, and efficiently manageable bath mat that is easily transported and/or stored.

SUMMARY OF THE INVENTION

It is an object of the present invention to provide a soft bubbling bath mat that uses a flexible soft support padding to improve comfort and better distribute a user's weight over the surface of the mat.

It is another object of the present invention to provide such a soft bubbling bath mat having a molded air channel configured to improve air distribution and ultimately the overall therapeutic aeration effect.

It is still an other object of the present invention to provide such a soft bubbling bath mat having at least one support tube located in an air channel that functions to improve airflow and maintain uniform air pressure throughout the air channel.

It is yet another object of the present invention to provide such a soft bubbling bath mat capable of being folded into a compact size for easy handling and storage.

It is yet still another object of the present invention to provide such a soft bubbling bath mat that, in conjunction with a compressed air source to provide warm air, maintains thermal water temperature.

These and other objects and advantages of the present invention are achieved by a soft bubbling bath mat that includes a mat body. Preferably, the mat body has two elongated sheets of molded flexible material secured together by weld lines. These weld lines include a perimetrical or peripheral weld, line or edge along the outer perimeter of the sheets, which forms a cavity for housing a foam pad sandwiched between the two sheets and adapted to fit between the outer perimetrical or peripheral weld line and an interior weld line or edge that forms an interior cavity or air passageway. The air passageway has a plurality of small apertures formed in an upper surface thereof and has a spine and rib configuration. The apertures preferably face upwardly when the mat is placed properly in a tub or basin. The passageway is closed at one end and connected at the other end to a hose that allows air to be fed from a compressed air source to the passageway through an inlet port. The compressed air source may be any suitable device capable of generating compressed air. The inlet port receives one end of the hose. Air is then forced through the passageway and out through the plurality of small apertures in the top surface of the passageway creating a bubbling massage effect. A foam pad is positioned in the mat body to provide a comfortable support surface for the user.

DETAILED DESCRIPTION OF THE INVENTION

Figure 1:
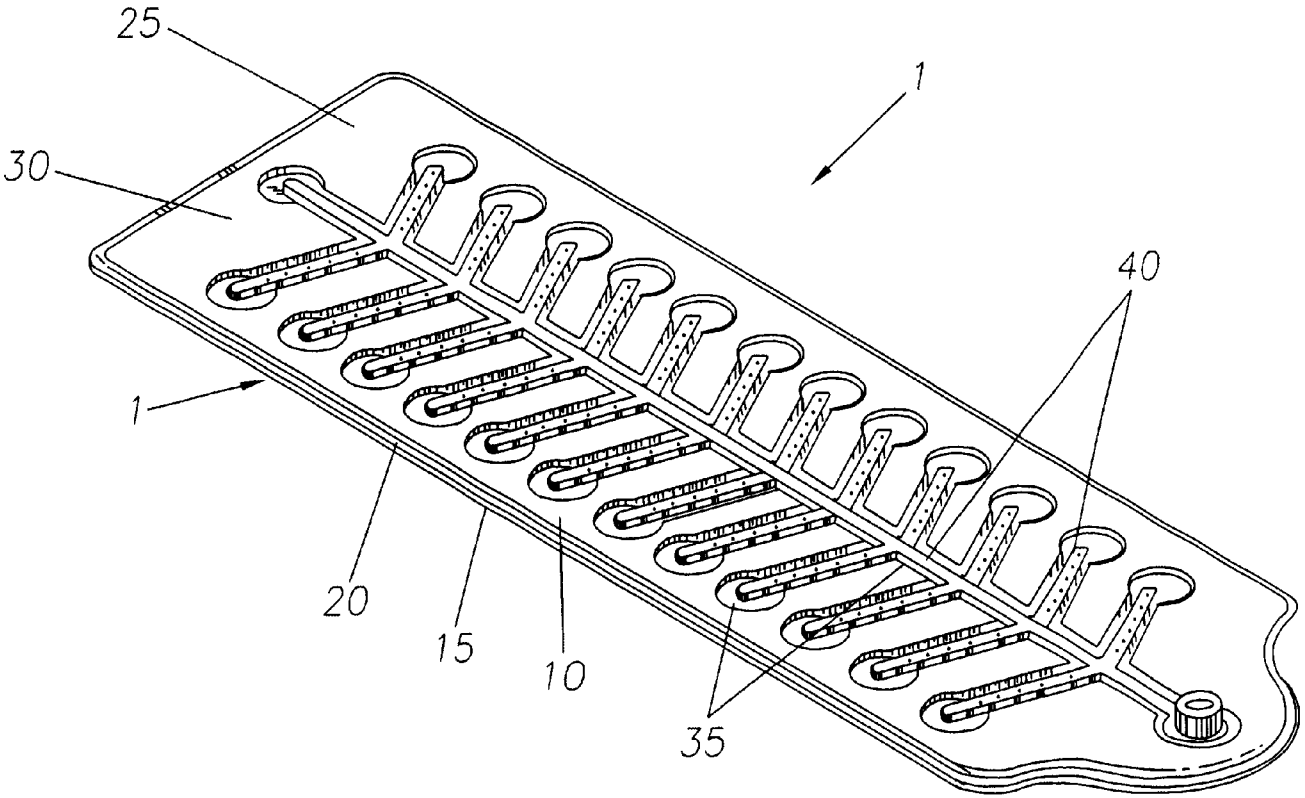
FIG. 1 is a perspective view of a soft bubbling bath mat, in accordance with a preferred embodiment of the present invention.

Referring to the drawings, and in particular FIG. 1, there is shown a soft bubbling bath mat in accordance with a preferred embodiment of the present invention generally represented by reference numeral 1. The bubbling bath mat 1 has a body or an outer cover 5. Preferably, outer cover 5 is molded and formed of an upper sheet 10 and a lower sheet 15, welded along a peripheral or perimetrical edge or line 20 to form a hollow, relatively elongated cavity 25. Cavity 25 houses a soft flexible foam pad 30 sandwiched between upper sheet 10 and lower sheet 15, and is adapted to fit between perimetrical weld line 20 and an interior edge or weld line 35. Weld line 35 forms an interior cavity or an air passageway 40 between upper sheet 10 and lower sheet 15.

Upper sheet 10 and lower sheet 15 preferably are two corresponding sheets of flexible, preferably soft material. Foam pad 30 is preferably a one-piece structure.

Figure 2:
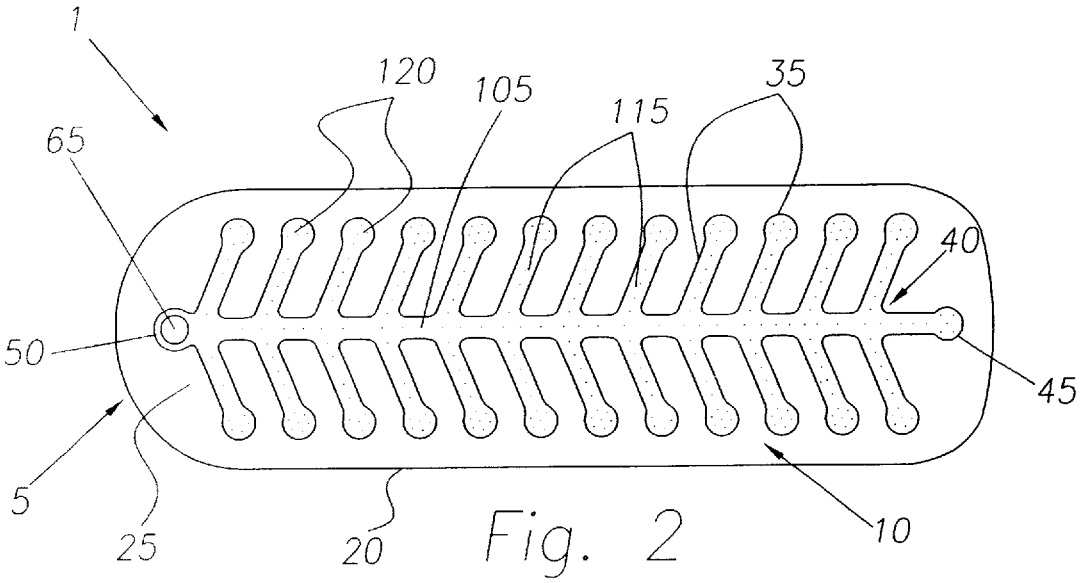
FIG. 2 is a top view, rotated 180 degrees, of the soft bubbling bath mat of FIG. 1.

Referring to FIG. 2, interior weld line 35 preferably runs along the entire outer perimeter of air passageway 40 creating a hermetically sealed line between air passageway 40 and cavity 25. Air passageway 40 has a main channel 105 running longitudinally along the centerline of bubbling bath mat 1. Air passageway 40 includes main channel 105 and a plurality of appendage channels 115 that are operatively connected to the main channel. Main channel 105 and appendage channels 115 each have an upper surface 75. Each upper surface 75 preferably has, one or more, and preferably several small apertures 70. Also, apertures 70 can also be placed on the sides of main channel 105 and/or any one of the appendage channels 115.

Main channel 105 is closed at one end 45, and is adapted to form an air inlet port 65 at the other opposite end 50. Air inlet port 65 can be connected to a hose (not shown), which allows air, preferably heated, to be fed from a compressed air source (not shown) into main channel 105. The air inlet port 65 preferably is adapted to be raised and lowered to facilitate connection to the compressed air hose and closure of the inlet port when mat 1 is sufficiently full of air. The compressed air in main channel 105 passes through the main channel and out by way of apertures 70 of air passageway 40 to create a therapeutic bubbling massage effects.

Figure 3:
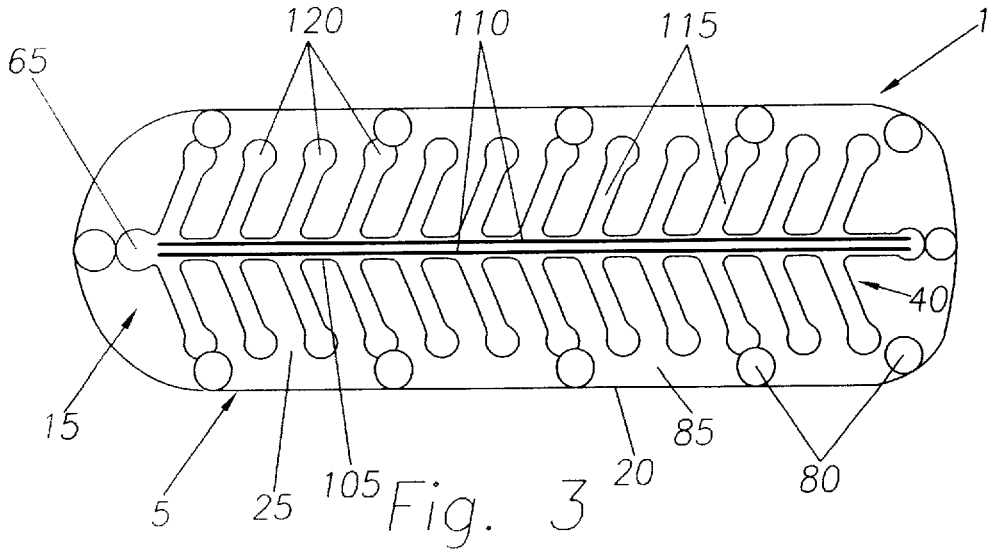
FIG. 3 is a bottom view of the soft bubbling bath mat of FIG. 1.

Referring to FIG. 3, main channel 105 has at least one, but preferably two hollow flexible support structures or tubes 110 therein running the entire length of the main channel. Tubes 110 ensure consistent airflow and air pressure is maintained when the full weight of a user is supported by bubbling bath mat 1. Referring to FIG. 2, appendage channels 115 bifurcate from main channel 105 at a slight angle from the perpendicular to the main channel in the downstream direction, i.e. towards end 45. The slight angle of each appendage channel 115 to the perpendicular of the axial extent of main channel 105 is about 10 degrees to about 80 degrees, preferably 45 degrees. Thus, the slight angle is an acute angle. Each channel 115 terminates in a closed passage or culdesac 120. Upper surface 75 of each culdesac 120 is preferably adapted such that apertures 70 form a circular pattern as shown in FIG. 2. This channel arrangement and aperture pattern further facilitates airflow in air passageway 40. This airflow reduces the likelihood of pressure loss at the extremities of air passageway 40 and improves the overall aeration effect.

Figure 4:
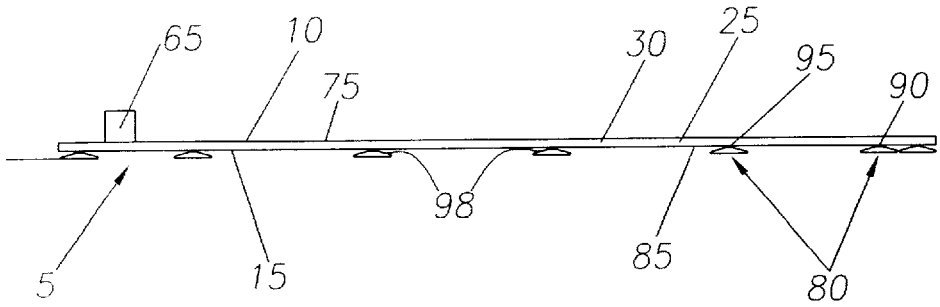
FIG. 4 is a side view, rotated 180 degrees, of the soft bubbling mat of FIG. 1.

Referring to FIGS. 3 and 4, bubbling bath mat 1 preferably has a plurality of suction cups 80 mounted to an exterior surface 85 of lower sheet 15. Each cup 80 has an upper disc 90 formed of a suitable flexible material that preferably is attached to surface 85 by any known suitable means. Each cup 80 preferably also has a cylindrical portion 95 that connects disc 90 to a lower concave cup portion 98. Cup portion 98 is adapted to contact the surface of a tub or basin so as to hold securely bubbling bath mat 1 in position.

In addition to the foregoing, bubbling bath mat 1, preferably is shaped to conform to the contours of a conventional tub or basin. Further, bubbling bath mat 1 is adapted to be easily removed and rolled up on itself into a compact size for efficient handling and storage. Also, bubbling bath mat 1, in conjunction with a compressed air source (not shown) that is adapted to produce heated air, can preferably produce warm bubbles that help to maintain water temperature.

The present invention having been thus described with particular reference to the preferred forms thereof, it will be obvious that various changes and modifications may be made therein without departing from the spirit of the present invention as defined herein.

We claim:

1. A bubbling bath mat comprising:

a body forming a hollow elongated first cavity with an outer peripheral edge and a hollow interior second cavity with an inner peripheral edge;

a pad being made of soft flexible material disposed between said outer peripheral edge and said inner peripheral edge, said inner peripheral edge of said second cavity forming a main channel running longitudinally along a centerline of said mat, said main channel having a plurality of appendage channels branching out therefrom, said main channel and said plurality of appendage channels having a plurality of apertures disposed in an upper surface thereof, wherein said main channel selectively receives compressed air, which is circulated through said main channel and said appendage channels to exit said plurality of apertures, said main channel has a hollow flexible support structure.

2. The mat of claim 1, wherein said main channel has a support structure.

3. The mat of claim 2, wherein said support structure is one or more hollow tubes.

4. The mat of claim 3, wherein said one or more hollow tubes are flexible.

* * * * *